US006238547B1

(12) United States Patent
Anastasijevic et al.

(10) Patent No.: US 6,238,547 B1
(45) Date of Patent: May 29, 2001

(54) PROCESS FOR CARRYING OUT CHEMICAL REACTIONS IN AN ELECTROCHEMICAL CELL

(75) Inventors: Nikola Anastasijevic, Altenstadt; Stefan Laibach, Geismar; Dietrich Werner, Messel, all of (DE)

(73) Assignee: Metallgesellschaft Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/319,402

(22) PCT Filed: Nov. 21, 1997

(86) PCT No.: PCT/EP97/06538

§ 371 Date: Jul. 9, 1999

§ 102(e) Date: Jul. 9, 1999

(87) PCT Pub. No.: WO98/24949

PCT Pub. Date: Jun. 11, 1998

(30) Foreign Application Priority Data

Dec. 2, 1996 (DE) ..... 196 49 832

(51) Int. Cl.[7] ..... B01D 53/00; B01D 59/40

(52) U.S. Cl. ..... 205/763; 205/496

(58) Field of Search ..... 205/763, 494, 205/496, 477, 551, 552, 554, 431, 441, 447, 687

(56) References Cited

U.S. PATENT DOCUMENTS

| | | | | |
|---|---|---|---|---|
| 3,996,118 | * | 12/1976 | Sanders | 204/91 |
| 5,104,497 | * | 4/1992 | Tetzlaff et al. | 204/59 R |
| 5,480,515 | * | 1/1996 | Gallien | 204/1.11 |
| 5,840,174 | * | 11/1998 | Lehmann et al. | 205/763 |
| 6,071,401 | * | 6/2000 | Engel et al. | 205/763 |

* cited by examiner

*Primary Examiner*—Kathryn Gorgos
*Assistant Examiner*—Michael J Feely
(74) *Attorney, Agent, or Firm*—Herbert Dubno; Jonathan Myers

(57) ABSTRACT

This invention concerns a process in which gases or gas mixtures are reacted in the presence of an ion-conductive liquid in an electro-chemical cell. The cell has at least one anode (2) and at least one cathode (3) to which an external electrical constant potential is applied so that a direct current flows through the ion-conducting liquid. In the lower region of the cell a sump (4) of ion-conductive liquid is located into which the electrodes are partially immersed. At least 20% of the entire surface of at least one of the electrodes is located outside the sump in an upper region through which gas flows. This upper region of the cell is sprayed or irrigated with the ion-conductive liquid and the electrode surface at least partially wet. During this wetting process, the gas flows across the electrode surface.

6 Claims, 2 Drawing Sheets

PROCESS FOR CARRYING OUT CHEMICAL REACTIONS IN AN ELECTROCHEMICAL CELL

Figure 1:
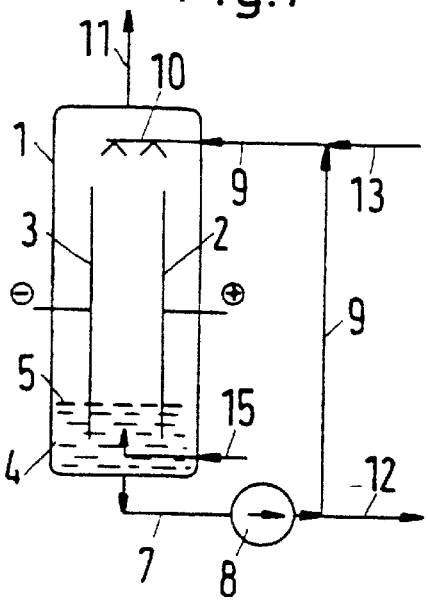

This invention relates to a process of reacting a gas or gas mixture in the presence of an ion-conducting liquid in an electrochemical cell comprising at least two electrodes, namely at least one anode and at least one cathode, where between the cathode and the anode an electric d.c. voltage is acting, which has been applied from the outside, and a direct current flows through the ion-conducting liquid.

Such process is described in the German Patent 195 04 920. The electrochemical cell contains an aqueous ammonium sulfide solution, which virtually completely covers the electrode surfaces. Gas containing free oxygen gets in contact with the solution through a gas diffusion cathode, so that ammonium polysulfide is formed as product. In this connection it should be noted that the liquid level in the cell cannot be chosen arbitrarily, as otherwise a disturbing leakage may occur. Furthermore, the current-voltage characteristic of the cell is unfavorably influenced by a high liquid level.

It is the object underlying the invention to perform the electrochemical reaction of gases with liquids also in the presence of catalysts in an inexpensive way with a high consumption, safely and also at a high pressure. In accordance with the invention this is achieved in the above-mentioned process in that in the lower portion of the cell a sump of the ion-conducting liquid is provided, into which the electrodes are immersed, that at least 20% of the entire surface of at least one of the electrodes are disposed outside the sump in an upper portion through which flows the gas or gas mixture, and that the upper portion is sprinkled or sprayed with the ion-conducting liquid, and the electrode surface is at least partly wetted while the gas or gas mixture flows along the electrode surfaces. In this way, different gases and liquids can be reacted. Usually, the gas or gas mixture is oxidized or reduced in the process.

All or at least part of the electrodes are disposed vertically in the sump of the ion-conducting liquid, and this sump ensures the flow of current between the electrodes. In most cases, 20–95% of the entire surface of at least one of the electrodes will be disposed above the sump. It is also possible that either the anode or the cathode is completely covered by the liquid of the sump. The electrodes may not only have a plate-shaped or a cylindrical design, but one electrode may also be designed as current-conducting bed or stacked packing of current-conducting elements contacting each other. Such bed or packing may additionally be coated with a catalyst.

Between the anode and the cathode of the cell a d.c. voltage is applied from the outside, which may be chosen in a wide range. The voltage between adjacent anodes and cathodes may lie in the range between 0.01 and 100 V, usually these voltages lie in the range from 0.1 to 10 V.

A large part of the entire electrode surface is disposed outside the liquid sump and is sprayed or sprinkled by the liquid serving as electrolyte. At the same time, the gas conducted into the cell gets in contact with the surfaces of the electrodes, which are disposed outside the sump. In this connection it is not important in what direction the gas flows. The gas may first of all be introduced into the liquid sump in the lower portion of the cell and flow upwards, or the gas is introduced into the upper portion of the cell, without conducting it through the sump, to the sprayed or sprinkled electrodes. With the gas, one component for the reaction to be performed in the cell, for instance oxygen or hydrogen, can be supplied. As gas, there can thus be introduced air, $O_2$, $H_2S$, $NH_3$, $SO_2$, $SO_3$, or a synthesis gas mixture ($CO+H_2$) or also mixtures of these gases into the cell.

The ion-conducting liquid contained in the cell, which also serves as electrolyte, will usually be an organic or inorganic solution or a melt.

The electrodes may consist of different materials, and they may be formed for instance from metal alloys, mixed oxides or be carbonaceous. When the electrode material itself has no catalytic effect, a catalyst may for instance be applied as coating on an electrically conductive substrate. In this way, both cathodes and anodes may be especially designed for different reactions. It is also possible that the electrodes are consumed during the reaction and act as what is called sacrificial electrodes. When high-carbon electrodes are employed, it may be expedient to make their surface hydrophobic, which is accomplished in a known manner by partly covering the surface with polytetrafluoroethylene.

When it is desired to subdivide the cell into a plurality of reaction chambers with partial exchange of liquid, this can be achieved by means of a diaphragm or also a plurality of diaphragms, which are porous and liquid-permeable in a manner known per se. A further possibility for the subdivision is to use ion-selective membranes, which are likewise known per se.

The desired product of the reaction in the cell may be contained in the liquid withdrawn from the cell or in the exhaust gas withdrawn or both in the exhaust gas and in the liquid. The separation and concentration of the product is then effected in a manner known per se.

The control of the desired reaction or reactions is effected for instance by varying the supply of gas and/or liquid and also by the flow of current in the cell and the electric voltage applied from the outside. Furthermore, the redox potential in the electrolyte sump can be measured and be used as control variable.

Figure 2:
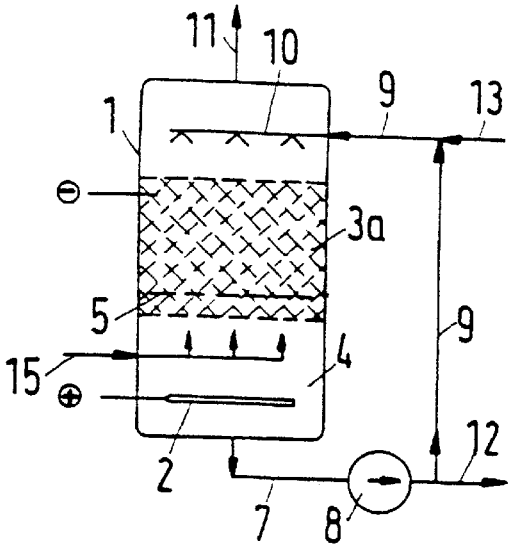
Figure 3:
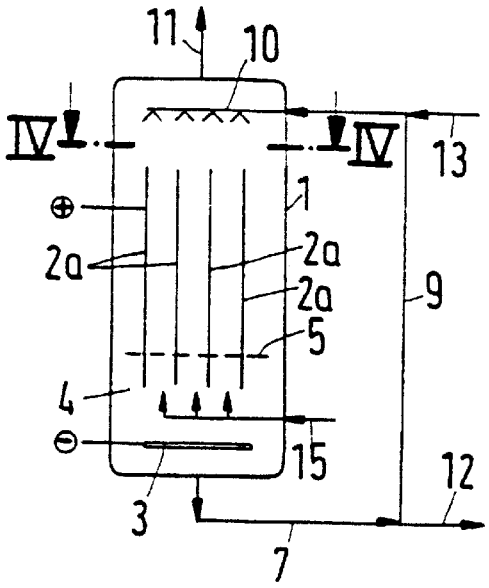
Figure 4:
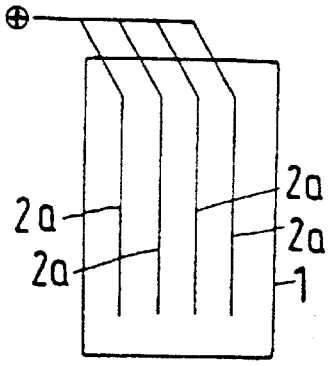
Figure 5:
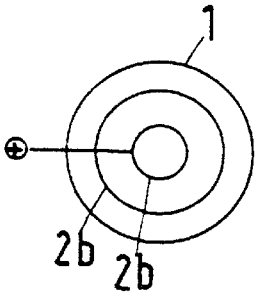
Figure 6:
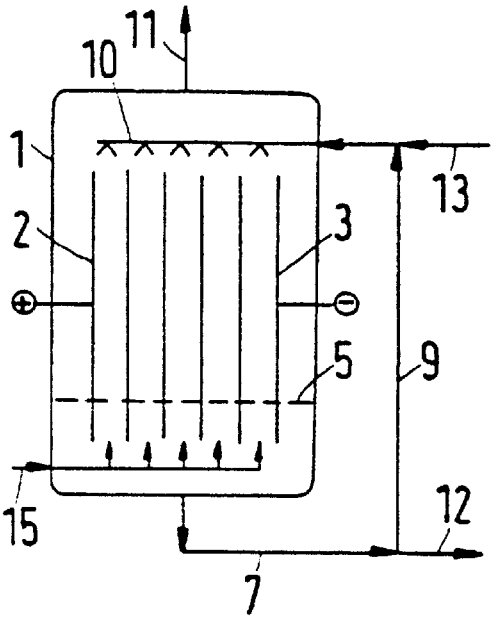
Figure 7:
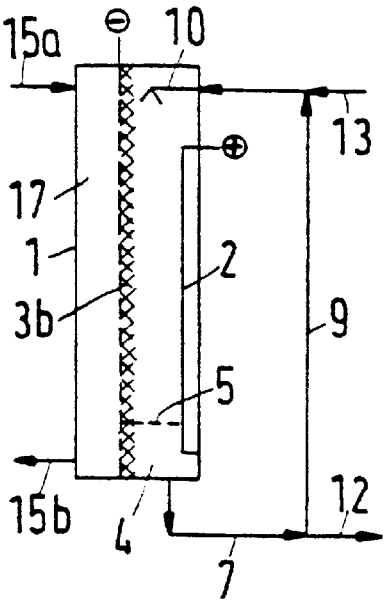

Embodiments of the process will be explained with reference to the drawing, wherein:

FIG. 1 shows a first variant of the electrochemical cell in a schematic representation, FIG. 2 shows a second variant of the cell, FIG. 3 shows a third variant of the cell, FIG. 4 shows a horizontal section along line IV—IV of FIG. 3, FIG. 5 shows the horizontal section through a cell similar to FIG. 3, FIG. 6 shows a cell with bipolar electrodes, and FIG. 7 shows a cell with a gas diffusion electrode.

In accordance with FIG. 1 the electrochemical cell is disposed in a liquid- and gas-tight housing 1 and comprises an anode 2 and a cathode 3. The two electrodes are connected with an external d.c. voltage source not represented here. In the lower portion of the cell a liquid sump 4 is provided, whose liquid surface is indicated by a broken line 5. The liquid serves as electrolyte, it is circulated in part and for this purpose recirculated through the line 7, the pump 8, the return line 9 and the distributor 10 and sprayed onto the electrodes from above. Part of the liquid is withdrawn as product through line 12, and fresh liquid is supplied to the circuit through line 13. A gas or gas mixture is supplied via line 15 and can first of all enter the sump 4, before it flows upwards between the sprayed electrodes, where the de- sired reaction takes place. Exhaust gas is removed from the housing 1 through line 11. Depending on the type of reaction, this gas can likewise be regarded as product.

As can be seen in FIG. 1, only the lower part of the electrodes 2 and 3 is disposed in the electrolyte sump 4, where a current can flow through this sump between the electrodes. At least 20% of the entire surface of the electrodes are disposed above the sump 4, and these surfaces are at least partly wetted by the liquid droplets originating from the distributor 10. At the same time, the gas or gas mixture coming from line 15 flows upwards along the wetted electrode surfaces. In most cases, 20 to 95% of the entire surface of the electrodes will be disposed above the sump 4.

In the cell of FIG. 2 one of the electrodes, in this case the cathode 3*a*, is designed as liquid- and gas-permeable bed or packing, where the elements are in electrically conducting contact with each other. The anode 2 is formed by a horizontal plate, which is completely disposed in the sump 4. The surface 5 of the sump extends up to the lower portion of the cathode 3*a*. The supply of gas is effected through line 15, and the remaining parts of the arrangement have the meaning already explained in conjunction with FIG. 1.

In the cell of FIG. 3, the anode is formed by a plurality of vertical, parallel plates 2*a*, whose lower portion extends into the liquid sump 4. The cathode 3 is designed as horizontal plate disposed in the sump 4. The remaining parts of the arrangement of FIG. 3 have already been explained in conjunction with FIG. 1, and the circulating pump 8 was omitted in FIG. 3 for simplification. In the horizontal section of FIG. 4, the vertical anode plates 2*a* can likewise be seen.

In contrast to FIG. 3 and 4, the anode can also be designed as a plurality of concentric cylinders 2*b*, which are open at the bottom and at the top and are partly disposed in the electrolyte sump. Moreover, such cell can be designed in accordance with FIG. 3. In contrast to the representation of FIG. 3 to 6, the electrically positive pole can be provided on the illustrated anode, and the negative pole can be pro- vided on the illustrated cathode, without otherwise changing the cell.

FIG. 6 shows a cell with bipolar electrodes, which may be designed as parallel, vertical plates and are disposed between the terminal anode 2 and the terminal cathode 3. In contrast to this, bipolar electrodes may also be designed as concentric cylinders. The remaining parts of the arrangement in accordance with FIG. 6 have already been explained in conjunction with FIG. 1.

In accordance with FIG. 7, the housing 1 comprises a gas diffusion cathode 3*b*, to which a liquid-free gas space 17 is associated. The gas is supplied through line 15*a* and withdrawn through line 15*b*. In the gas space 17 part of the gas flows through the porous structure of the gas diffusion cathode 3*b* to get in contact with the electrolyte, which is disposed in the sump 4 and is sprayed from the distributor 10. Inside the structure of the cathode 3*b*, gas and liquid thus get in contact with each other, but without disturbing quantities of gas or liquid completely penetrating through the cathode structure. In a manner known per se, the gas diffusion cathode 3*b* may consist of a metal net and a carbon cloth attached thereto. Advantageously, the fibers of the carbon cloth have been made hydrophobic at least in part, as is likewise known.

EXAMPLE 1

In the laboratory, an arrangement in accordance with FIG. 3 is employed, but the cathode 3 described there now becomes the anode. The anode is arranged horizontally and fully immersed in the sump 5, it consists of a circular disk of titanium expanded metal activated with platinum, the diameter is 100 mm, and the thickness is 1 mm. The cathode is formed by 8 parallel, vertical plates having a height of 90 mm and a width of 50 mm, which have a distance of 4 mm and are conductively connected with each other. The cathode plates consist of titanium expanded metal activated with platinum. The cathode plates are immersed in the electrolyte sump for 20 mm. The container 1 is made of glass.

The cathode plates are sprinkled from above with an aqueous solution, which contains 5 g/l NaOH and 6.3 g/l $Na_2SO_3$ and has a temperature of 50° C. Air is supplied through line 15, and the exhaust air of line 11 is partly recirculated to line 15. The amount of recycle gas is 450 Nl/h, fresh air is admixed to the recycle gas in an amount of 100 Nl/h. The supply of gas into the sump 4 is effect 10 mm below the liquid level 5, the circulating amount of liquid is 4 l, and the object of the process is the oxidation of sulfite ions to form sulfate ions.

A first experiment was made with a current of 1A, for control purposes a second experiment was made without current, and finally a third experiment was performed completely without electrodes. After a period of 2 hours for each experiment, the following amounts of sulfite ions were oxidized to form sulfate ions:

| | |
|---|---|
| 1st experiment | 66 wt% |
| 2nd experiment | 17 wt% |
| 3rd experiment | 5 wt% |

EXAMPLE 2

In the laboratory, an apparatus in accordance with FIG. 2 is employed, where the anode 2 is formed by a circular graphite web with a diameter of 100 mm and a thickness of 25 mm, which extends horizontally in the sump 4 of the glass container 1. The cathode 3*a* is formed by four graphite web layers lying one above the other with a total height of 100 mm, where at the lower and upper end of the cathode a polypropylene net is disposed for stabilization. The cathode 3*a* is immersed into the sump 4 for 20 mm, and the diameter of the cathode like the inside diameter of the container 1 is 120 mm.

An aqueous solution of 4.2 g/l NaOH and 8.5 g/l $Na_2SO_3$ is recirculated in an amount of 4 l and sprayed onto the cathode 3*a*, and the supply of gas is effected as in Example 1. Just as in Example 1, three different experiments are each performed for 2 hours, and the following results were obtained with respect to the amount of sulfite ions oxidized to form sulfate ions:

| | |
|---|---|
| 1st experiment (current 1A) | 47 wt% |
| 2nd experiment (currentless) | 9 wt% |
| 3rd experiment (without electrodes) | 3 wt% |

What is claimed is:

1. A process for reacting a gas or a gas mixture with an ion-containing liquid in an electrochemical cell to obtain a gaseous or liquid reaction product which comprises the steps of:

(a) providing an electrochemical cell which comprises (1) at least two electrodes having a plank-shaped or cylindrical design, including at least one anode and at least one cathode;

(2) a d.c. power supply in electrical contact with each of said electrodes, said d.c. power supply applied to each of said electrodes from outside of the cell;

(3) a liquid and gas-tight housing surrounding said at least two electrodes;

(4) a sump at the bottom of the electrochemical cell comprising the ion-containing liquid in which the electrodes are immersed or partially immersed;

(5) a gas inlet for introducing the gas or gas mixture reactive with the ion-containing liquid in the electrochemical cell;

(6) an upper portion of the electrolytic cell above the liquid line of the ion-containing liquid in the sump wherein at least 20% of the entire surface of the at least one electrode partially immersed in the ion-containing liquid is disposed above the liquid line;

(7) a gas outlet for removing the gaseous reaction product from the electrochemical cell;

(8) an inlet for introducing fresh ion-containing liquid into the upper portion of the electrochemical cell;

(9) an outlet for removing spent ion-containing liquid or the liquid reaction product from the sump of the electrolytic cell;

(10) means for spraying a portion of the ion-containing liquid onto the at least 20% of the entire surface of the electrode disposed above the sump in the upper portion of the electrolytic cell; and

(11) a pump for recirculating the ion-containing liquid from the sump to the means for spraying disposed above the sump;

(b) spraying the at least 20% of the entire surface of the at least one of the electrodes disposed above the liquid line of the ion-containing liquid in the sump to wet the entire surface of the electrode above the liquid line;

(c) introducing a gas or gas mixture reactive with the ion-containing liquid into the sump containing the ion-containing liquid; and (d) electrolytically reacting the ion-containing liquid with the gas or gas mixture reactive with the ion-containing liquid along the surface of the electrode above the liquid line to obtain a reaction product.

2. The process defined in claim 1 wherein according to step (d) the gas or gas mixture is oxidized in contact with the ion-containing liquid and the electrodes above the liquid line of the ion-containing liquid in the sump.

3. The process defined in claim 1 wherein according to step (d) the gas or gas mixture is reduced in contact with the ion-containing liquid and the electrodes above the liquid line of the ion-containing liquid in the sump.

4. The process defined in claim 1 wherein according to step (a) 20 to 95% of the entire surface of the at least one electrode partially immersed in the ion-containing liquid is disposed above the liquid line.

5. The process defined in claim 1 wherein according to step (a) the surface of at least one of the electrodes immersed or partially immersed in the ion-containing liquid is catalytically active.

6. The process defined in claim 1 wherein at least one of the electrodes is a gas diffusion electrode, one side of which is porous and is in contact with the gas or gas mixture and the other side of which is sprayed with the ion-containing liquid.

* * * * *